US011627817B1

(12) United States Patent
Flannery et al.

(10) Patent No.: US 11,627,817 B1
(45) Date of Patent: Apr. 18, 2023

(54) BASSINET APPARATUS

(71) Applicant: Regalo International, LLC, Burnsville, MN (US)

(72) Inventors: Mark A. Flannery, Longboat Key, FL (US); William D. Butterfield, River Falls, WI (US); Shannon R. Bickel, Lakeville, MN (US)

(73) Assignee: Regalo International, LLC, Burnsville, MN (US)

( * ) Notice: Subject to any disclaimer, the term of this patent is extended or adjusted under 35 U.S.C. 154(b) by 109 days.

(21) Appl. No.: 17/146,347

(22) Filed: Jan. 11, 2021

(51) Int. Cl.
*A47D 9/00* (2006.01)

(52) U.S. Cl.
CPC ..... *A47D 9/00* (2013.01)

(58) Field of Classification Search
CPC . A47D 9/00; A47D 9/005; A47D 9/02; A47D 7/005; A47D 11/007
See application file for complete search history.

(56) References Cited

U.S. PATENT DOCUMENTS

| | | | | |
|---|---|---|---|---|
| 6,430,762 | B1 * | 8/2002 | Cheng | A47D 7/002 5/93.2 |
| 9,138,070 | B1 * | 9/2015 | Shamie | A47D 9/005 |
| 10,159,356 | B1 | 12/2018 | Flannery et al. | |
| 10,779,659 | B1 | 9/2020 | Flannery et al. | |
| 2016/0183698 | A1 * | 6/2016 | Szymanski | A47D 13/06 5/99.1 |
| 2019/0000240 | A1 * | 1/2019 | Rabbany | A47C 31/007 |
| 2020/0352351 | A1 * | 11/2020 | Mountz | A47D 9/005 |
| 2021/0137280 | A1 * | 5/2021 | Villano | A47D 15/003 |

FOREIGN PATENT DOCUMENTS

| | | | | |
|---|---|---|---|---|
| ES | 1127830 U | * 10/2014 | | A47D 9/02 |

* cited by examiner

*Primary Examiner* — Peter M. Cuomo
*Assistant Examiner* — Adam C Ortiz

(57) ABSTRACT

The present bassinet apparatus includes a receptacle having an open top, a closed bottom, and an endless sidewall between the open top and closed bottom. A floor portion in the closed bottom is rotatable onto itself for reduction in size of the receptacle for shipment and storage. A frame for the receptacle includes an oblong portion that is breakable down and legs that are breakable down to reduce the size of the frame for shipment and storage.

11 Claims, 11 Drawing Sheets

BASSINET APPARATUS

FIELD OF THE INVENTION

The present invention relates generally to a bassinet apparatus, and particularly to a bassinet apparatus that is reducible in size for shipment and storage without sacrificing stability of the end product and a safe environment for the child.

BACKGROUND OF THE INVENTION

It has become popular to shop at stores that offer relatively inexpensive furniture items in unassembled form. The buyer then takes such items home for assembly, hoping that that the instructions for assembly are easy to understand and that the end product is just like great-grandfather used to make: stable and safe for the newest member of the family.

SUMMARY OF THE INVENTION

A feature of the present invention is the provision in a bassinet apparatus, of a frame that includes an oblong portion that defines a plane.

Another feature of the present invention is the provision in a bassinet apparatus, of the oblong portion having a first curved end section and a second curved end section, where the first and second curved end sections oppose each other.

Another feature of the present invention is the provision in a bassinet apparatus, of the oblong portion having first and second intermediate straight sections, where the first intermediate straight section is between the first and second curved end sections, where the second intermediate straight section is between the first and second curved end sections, and where the first and second intermediate straight sections oppose each other.

Another feature of the present invention is the provision in a bassinet apparatus, of first, second, third, and fourth oblique legs engaged to the oblong portion for supporting the bassinet apparatus relative to a surface, where the first, second, third, and fourth oblique legs are oblique relative to the plane defined by the oblong portion.

Another feature of the present invention is the provision in a bassinet apparatus, of a receptacle engaged to and depending from the oblong portion, where the receptacle includes an open top, a closed bottom, and an endless sidewall between the open top and closed bottom.

Another feature of the present invention is the provision in a bassinet apparatus, of a first sleeve for receiving the first intermediate straight section of the oblong portion of the frame, where the first sleeve includes first and second opposing open ends, where the first sleeve defines a first closed tube between the first and second opposing open ends of the first sleeve, where the first closed tube is openable between the first and second open ends of the first sleeve only by destroying an integrity of the first sleeve, and where the frame is engaged and disengaged to the first sleeve through the first and second open ends of the first sleeve.

Another feature of the present invention is the provision in a bassinet apparatus, of a second sleeve for receiving the second intermediate straight section of the oblong portion of the frame, where the second sleeve includes first and second opposing open ends, where the second sleeve defines a second closed tube between the first and second opposing ends of the second sleeve, where the second closed tube is openable between the first and second open ends of the second sleeve only by destroying an integrity of the second sleeve, and where the frame is engaged and disengaged to the second sleeve through the first and second open ends of the second sleeve.

Another feature of the present invention is the provision in a bassinet apparatus, of a third sleeve for receiving the first curved end section of the oblong portion of the frame, where the third sleeve includes first and second ends and a connection between the first and second ends of the third sleeve, where the third sleeve is openable along the connection of the third sleeve such that the third sleeve may be engaged and disengaged laterally from the first curved end section of the oblong portion of the frame.

Another feature of the present invention is the provision in a bassinet apparatus, of a fourth sleeve for receiving the second curved end section of the oblong portion of the frame, where the fourth sleeve includes first and second ends and a connection between the first and second ends of the fourth sleeve, where the fourth sleeve is openable along the connection of the fourth sleeve such that the fourth sleeve may be engaged and disengaged laterally from the second curved end section of the oblong portion of the frame.

Another feature of the present invention is the provision in a bassinet apparatus, of the first open end of the first sleeve being adjacent to the first end of the third sleeve, where the second open end of the first sleeve is adjacent to the first end of the fourth sleeve, where the first open end of the second sleeve is adjacent to the second end of the third sleeve, and where the second open end of the second sleeve is adjacent to the second end of the fourth sleeve.

Another feature of the present invention is the provision in a bassinet apparatus, of the oblong portion of the frame including first and second segments, where the first segment includes an entirety of the first curved end section, part of the first intermediate straight section, and part of the second intermediate straight section, where the second segment includes an entirety of the second curved end section, part of the first intermediate straight section, and part of the second intermediate straight section, and where the first and second segments are engagable to and disengagable from each other.

Another feature of the present invention is the provision in a bassinet apparatus, of the first intermediate straight section of the oblong portion of the frame leading into the first curved end section of the oblong portion of the frame at a first location, where the first intermediate straight section of the oblong portion of the frame leads into the second curved end section of the oblong portion of the frame at a second location, where the second intermediate straight section of the oblong portion of the frame leads into the first curved end section of the oblong portion of the frame at a third location, where the second intermediate straight section of the oblong portion of the frame leads into the second curved end section of the oblong portion of the frame at a fourth location, and where the first, second, third, and fourth legs depend from the first, second, third, and fourth locations, respectively.

Another feature of the present invention is the provision in a bassinet apparatus, of each of the first, second, third, and fourth legs including upper and lower leg portions, where the upper leg portion includes an integral connection with the oblong portion of the frame such that removing the upper leg portion from the oblong portion of the frame at the integral connection destroys an integrity of such integral connection.

Another feature of the present invention is the provision in a bassinet apparatus, of each of the first, second, third, and fourth legs including upper and lower leg portions, where the lower leg portion of each of the first, second, third, and fourth legs is engagable and disengagable from the upper leg portion of each of the first, second, third, and fourth legs, respectively.

Another feature of the present invention is the provision in a bassinet apparatus, of the closed bottom including a pocket, where the pocket includes an upper oblong layer and a lower oblong layer, where the upper and lower oblong layers include an oblong connection therebetween, where a first portion of the oblong connection is openable and closeable, where a second portion of the oblong connection is fixed such that opening the second portion of the oblong connection destroys an integrity of the second portion of the oblong connection, and where an oblong floor support is disposed in the pocket between the upper and lower oblong layers.

Another feature of the present invention is the provision in a bassinet apparatus, of the floor support including first and second portions, where the first and second portions include an identical shape, where the first and second portions are pivotally engaged to each other, where the first and second portions include a compact shape where peripheries of the first and second portions are aligned with each other, where the first and second portions include an operating oblong shape, and where the first and second portions are pivotable from the compact shape to the operating oblong shape.

Another feature of the present invention is the provision in a bassinet apparatus, of each of the third and fourth sleeves including an upper portion and a lower portion, where a lower edge of the upper portion and an upper edge of the lower portion of the third sleeve are separated by the connection of the third sleeve, where a lower edge of the upper portion and an upper edge of the lower portion of the fourth sleeve are separated by the connection of the fourth sleeve, where the upper and lower edges of the third sleeve are spaced apart from each other when the upper and lower portions of the third sleeve are disengaged from each other by such connection, and where the upper and lower edges of the fourth sleeve are spaced apart from each other when the upper and lower portions of the fourth sleeve are disengaged from each other by such connection.

Another feature of the present invention is the provision in a bassinet apparatus, of first and second flexible flaps, where the first flap covers the connection of the third sleeve, where the first flap extends parallel to the first curved end section of the oblong portion of the frame, where the second flap covers the connection of the fourth sleeve, and where the second flap extends parallel to the second curved end section of the oblong portion of the frame.

Another feature of the present invention is the provision in a bassinet apparatus, of the first and second curved end sections being equidistance from a laterally extending vertical plane, where the laterally extending vertical plane extends through the bottom of the receptacle, where the bottom of the receptacle includes a pocket, where the pocket includes a lowermost layer and an upper layer and further includes an oblong floor support in the pocket between the lowermost layer and upper layer, where the oblong floor support includes first and second portions that overlap each other and are rotatable relative to each other, where the laterally extending vertical plane passes through each of the first and second portions of the oblong floor support, and where the oblong floor support includes a degree of rigidity greater than the lowermost layer of the pocket and greater than the upper layer of the pocket.

Another feature of the present invention is the provision in a bassinet apparatus, of the closed bottom including a pocket, where the pocket is oblong in shape, where the pocket includes a lowermost layer and an upper layer, where each of the lowermost layer and upper layer is oblong in shape, and where the pocket is accessible through an opening in the closed bottom.

Another feature of the present invention is the provision in a bassinet apparatus, of a floor support, where the floor support is oblong in shape, where the floor support is insertable into the pocket through the opening, where the floor support includes a greater rigidity than the lowermost layer of the pocket, and where the floor support includes a greater rigidity than the upper layer of the pocket.

Another feature of the present invention is the provision in a bassinet apparatus, of a first sleeve for receiving the first intermediate straight section of the oblong portion of the frame, where a second sleeve receives the second intermediate straight section of the oblong portion of the frame, where a third sleeve receives the first curved end section of the oblong portion of the frame, and where a fourth sleeve receives the second curved end section of the oblong portion of the frame.

An advantage of the present invention is that the present bassinet apparatus takes up relatively little space during shipment, while in storage, on the shelf in a store, at home in a closet, or in the car. One feature contributing to this advantage is that the oblong portion of the frame may be assembled and disassembled. Another feature contributing to this advantage is that a large portion of each of the legs is engagable to and disengagable from the frame. Another feature contributing to this advantage is that a portion of the receptacle, namely, a relatively rigid floor portion, is rotatable onto itself from its expansive operating position at the bottom of the bassinet receptacle.

Another advantage of the present invention is that the bassinet apparatus is, as well as being small in size in its broken down state, is relatively lightweight. One feature contributing to this advantage is that the oblong portion of the frame is tubular. Another feature contributing to this advantage is that the leg portion of the frame is tubular. Another feature contributing to this advantage is that the endless sidewall of the receptacle includes first and second end wall portions formed of see through mesh and first and second side portions formed of see through mesh. Another feature contributing to this advantage is that a floor support is formed of a wood or of engineered wood or of a wood product. Mesh and wood are relatively lightweight.

Another advantage of the present invention is that the end product, after assembly, is stable and secure. One feature contributing to this advantage is that there is a fabric lock to the frame. End fabric sleeves must be opened before the frame can be removed from the bassinet receptacle. Another feature contributing to this advantage is that the button locks for disengaging frame portions from each other are hidden in intermediate fabric sleeves that are not openable and closeable, i.e., are openable and closeable only by destroying the integrity of the intermediate fabric sleeves themselves. Another feature contributing to this advantage is that legs of the bassinet apparatus are oblique to a plane defined by an oblong portion of the bassinet apparatus, which oblong portion supports the receptacle that holds the infant child, and which obliqueness provides a wide foot plant. Another feature contributing to this advantage is that multiple steps must be taken prior to the frame being removed from the bassinet receptacle: 1) a first end fabric sleeve must be opened, 2) a second end fabric sleeve must be opened, 3) a first button lock on a first side of the frame must be unlocked, and 4) a second button lock on a second side of the frame must be unlocked.

BRIEF DESCRIPTION OF THE DRAWINGS

FIG. 8A is a perspective end view of the bassinet of FIG. 2 and shows zipped up receptors for U-shaped portions of the tubular frame, and further shows turned up flaps for hiding the zippers of the zipped up receptors, whereas FIG. 3 shows such flaps turned down.

DESCRIPTION

Figure 1B:
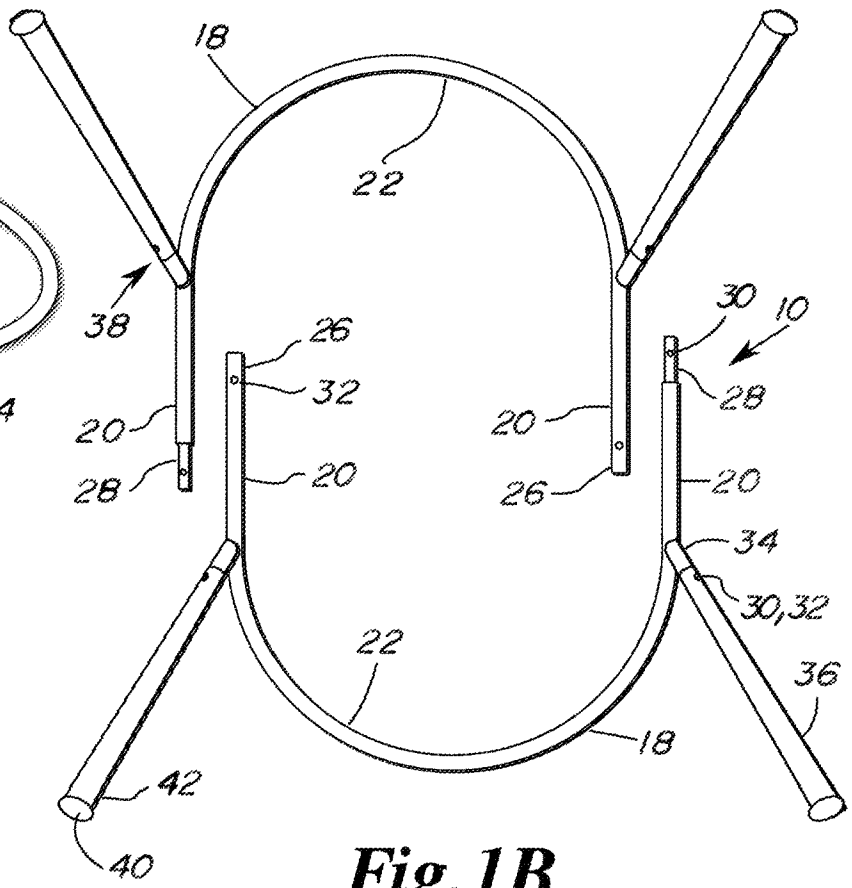
FIG. 1B is a bottom perspective view of the tubular frame of FIG. 1A in a partially disassembled state.
Figure 1A:
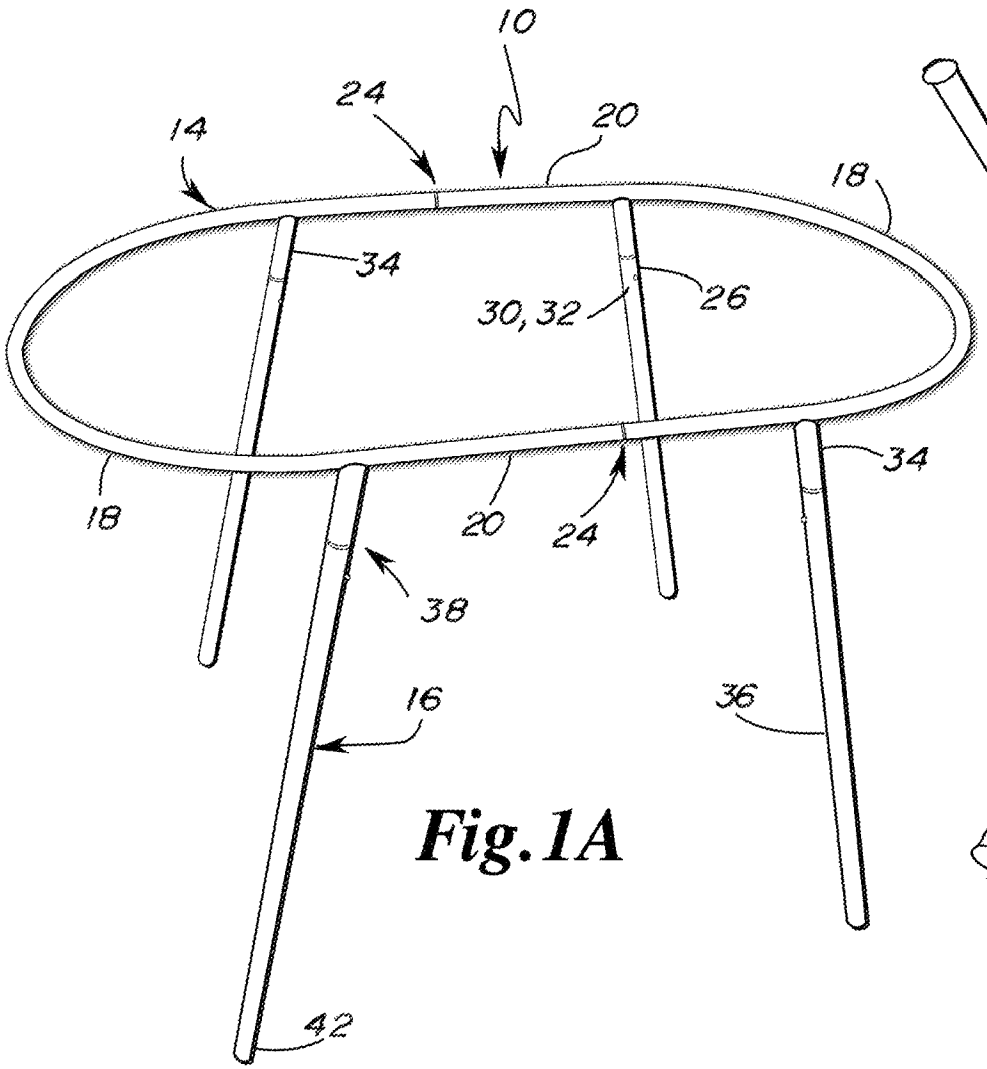
FIG. 1A is a side perspective view of the tubular frame for the present infant bassinet apparatus in the assembled state.
Figure 2:
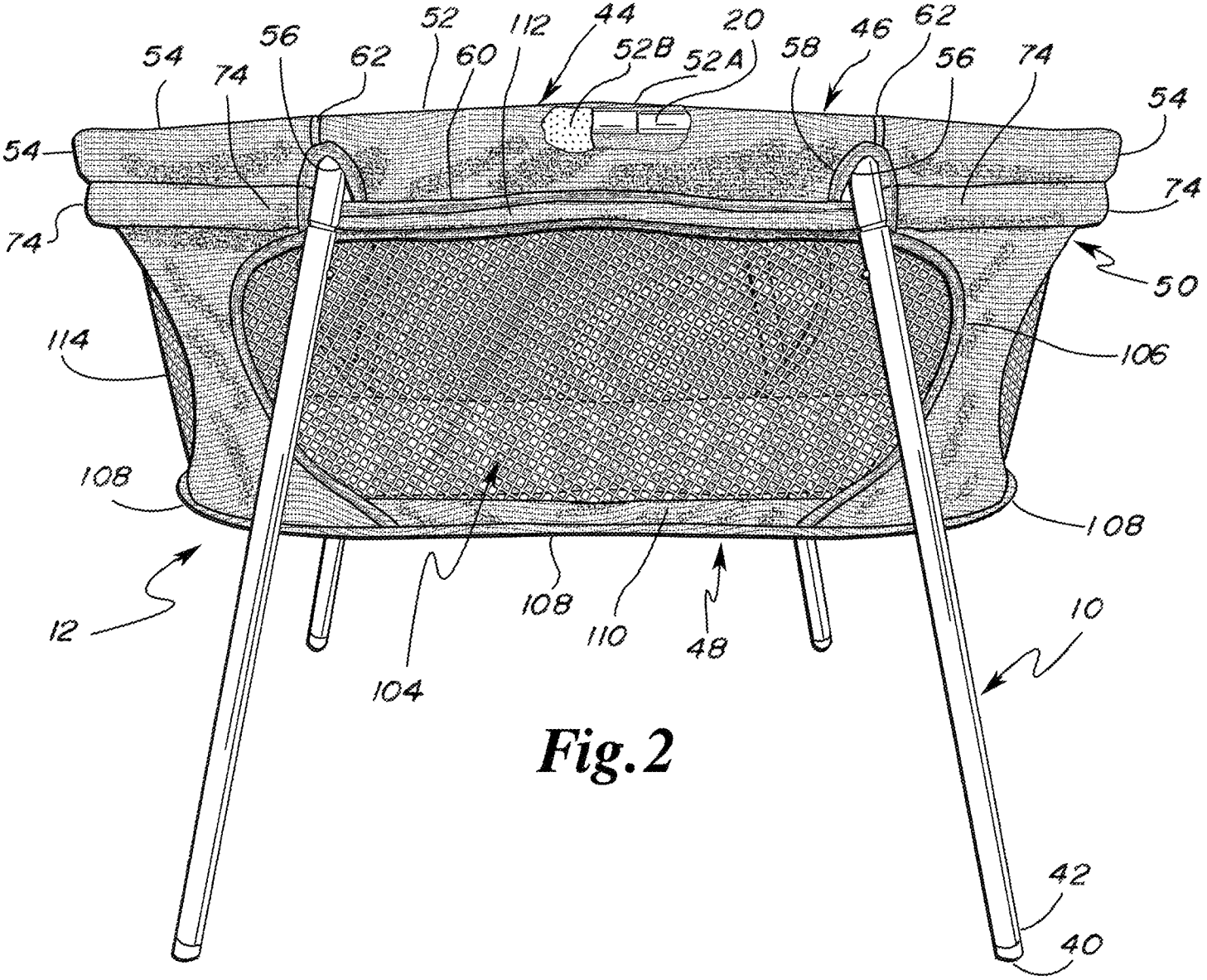
FIG. 2 is a side perspective view of the present infant bassinet apparatus.

FIGS. 1A and 1B show a frame 10 for a bassinet apparatus 12 of FIG. 2. Frame 10 includes an oblong or elongate portion 14 and a set of first, second, third, and fourth legs 16. Oblong portion 14 defines a plane. "Oblong" means a shape that deviates from a square, circular, or spherical form by elongation in one dimension. Oblong portion 14 is tubular.

Oblong portion 14 of the frame 10 includes first and second curved end sections 18. Each of the curved end sections 18 is U-shaped and may be circular if desired. Each of the curved end sections 18 runs from one leg 16 to an opposing leg 16 and does not include any straight sections. The curved end sections 18 oppose each other.

Oblong portion 14 of the frame 10 includes first and second intermediate straight sections 20. Each of the intermediate straight sections 20 runs from one leg 16 to another leg 16 and does not include any curved sections. Each of the intermediate straight sections 20 runs from one curved end section 18 to the other curved end section 18. The first and second intermediate straight sections 20 oppose each other.

Oblong portion 14 of the frame 10 includes first and second segments 22. Each of the first and second segments 22 includes an entirety of one of the curved end sections 18, part of the first intermediate straight section 20, and part of the second intermediate straight section 20. First and second segments 22 are engagable and disengagable from each other by first and second connections 24. Each of the connections includes a female end 26 and a male end 28 that are lockable to each other by a button 30. Button 30 is spring biased and pushable into the male end 28, after which the male end 28 is slideable into the female end 26, after which the button 30 pops into button hole 32 formed in the female end 26, whereupon the ends 26, 28 are releaseably locked to each other. To unlock the ends 26, 28 from each other, the button 30 is depressed, whereupon the male end 28 is pullable out of the female end 26.

Each of the legs 16 includes an upper portion 34 and a lower portion 36. The upper portion 34 is integrally connected to location on the oblong portion 14 that is a transition from one of the intermediate straight sections 20 to one of the curved end sections 18. In other words, each of the upper portions 34 of the legs 16 is integrally connected to an end of the intermediate straight section 20. Each of the upper portions 34 of the legs 16 is straight and depends obliquely from the plane defined by the oblong portion 14. The upper portions 34 and lower portions 36 of the legs 16 have different lengths. The upper portions 34 of the legs 16 are relatively short in length and the lower portions 36 of the legs 16 are relatively great in length.

Each of the lower portions 36 of the legs 16 is straight and defines a straight line in combination with one respective upper portion 24. The upper end of each of the lower portions 36 is releaseably engaged to the lower end of the upper portions 34 by a male/female connection 38. Male/female connection 38 is identical in structure to the male/female connection 24 of the oblong portion 14, where such male/female portion 24 of the oblong portion 14 includes a female end 26, a male end 28, a button 30, and a button hole 32. Parts of the male/female connection 38 may be greater in size than parts of the male/female connection 24. Buttons 30 and button holes 32 of the male/female connection 38 can be seen in FIGS. 1A and 1B. Male ends 28 of the male/female connection 38 cannot be seen in FIGS. 1A and 1B. Female ends 26 of the male/female connection 38 can be seen in FIGS. 1A and 1B. Legs 16 are tubular. Each of the legs 16 includes a cap 40 that can be plugged into tubular lower ends 42 of each of the legs 16. Cap 40 can have a rounded or spherical lower end. Lower leg ends 42 define a wide and stable foot plant for the frame 10 and bassinet apparatus 10. In other words, if true vertical lines depended directly from the oblong portion 14 to the surface upon which the bassinet apparatus 12 is supported, such true vertical lines would define an oblong shape on such surface identical to oblong portion 14, and the lower ends 42 and their respective caps 40 would fall outside of such oblong shape on such surface.

Frame 10 includes six pieces when broken down. Four of such pieces are the four respective lower leg portions 36. The fifth piece is one of the segments 22 having two integrally connected upper leg portions 24. The sixth piece is the other of the segments 22 having two integrally connected upper leg portions 24.

It should be noted that an attempt to remove one of the upper leg portions 24 from the oblong portion 14 would destroy the integrity of such connection. In other words, such a connection is integral. In still other words, each of the upper leg portions 24 may be welded to its respective segment 22 of the oblong portion 14 of the frame 10.

Upper leg portions 34 are engageable to and disengagable from their respective lower leg portions 36 by respective male/female connections 38.

The first intermediate straight section 20 of the oblong portion 14 of the frame 10 leads into the first curved end section 18 of the oblong portion 14 of the frame 10 at a first location. One of the upper leg portions 34 depends from the oblong portion 14 at this first location. The first intermediate straight section 20 of the oblong portion 14 of the frame 10 leads into the second curved end section 18 of the oblong portion 14 of the frame 10 at a second location. One of the upper leg portions 34 depends from the oblong portion 14 at this second location. The second intermediate straight section 20 of the oblong portion 14 of the frame 10 leads into the first curved end section 18 of the oblong portion 14 of the frame 10 at a third location. One of the upper leg portions 34 depends from the oblong portion 14 at this third location. The second intermediate straight section 20 of the oblong portion 14 of the frame 10 leads into the second curved end section 18 of the oblong portion 14 of the frame 10 at a fourth location. One of the upper leg portions 34 depends from the oblong portion 14 at this fourth location. In other words, first, second, third, and fourth legs 16 depend from such first, second, third, and fourth locations, respectively.

As shown in FIG. 2, bassinet apparatus 12 includes the frame 10 and a receptacle 44. Receptacle 44 includes an open top 46, a closed bottom 48, and an endless sidewall 50 between the open top 46 and the closed bottom 48.

Receptacle 44 depends from the oblong portion 14 of the frame 10 by engaging the oblong portion 14 with first and second sleeves 52 and with third and fourth sleeves 54. Sleeves 52, 54 may be considered to be part of the endless sidewall 50.

First and second sleeves 52 engage the intermediate straight sections 20 of the oblong portion 14 of the frame 10. First and second sleeves 52 are flexible fabric tubes that are fixed in construction. Each of the first and second sleeves 52 have a pair of openings 56 disposed at locations on the oblong portion 14 of the frame 10 where the upper leg portions 34 are integrally connected to the oblong portion 14 of the frame 10. Female ends 26 and male ends 28 of the segments 22 of the oblong portion 14 of the frame 10 are inserted into the openings 56 and then engaged to each other when in the first or second sleeve 52. Opening 56 is formed in part by a U-shaped strip 58 of reinforcing flexible fabric material. Each of the first and second sleeves 52 is a generally inverted U-shaped piece of flexible fabric material where the free ends of the inverted U are engaged to each other, such as by adhesive or stitching, along with a strip 60 of reinforcing flexible fabric material. The opposite ends of each of the first and second sleeves 52 are engaged to ends of the third and fourth sleeves 54, respectively, which connection is reinforced by a strip 62 of reinforcing flexible fabric material. Thus each of the first and second sleeves 52 are bounded by strips 56, 60, and 62. First and second sleeves 52 are fixed and are not openable. Any attempt to open up the first and second sleeves 52 would destroy the integrity of the first and second sleeves 52. The length of each of the first and second intermediate straight sleeves 52 is about the length of each of the intermediate straight sections 20 of the oblong portion 14 of the frame 10.

Third and fourth sleeves 54 are tubular and in communication with the first and second sleeves 52. Third and fourth sleeves 54 engage the curved end sections 18 of the oblong portion 14 of the frame 10. Each of the third and fourth sleeves 54 runs or extends from one end of one of the first and second sleeves 52 to one end of the other of the first and second sleeves 52 where such ends of such sleeves 52 are on the same end of the oblong portion 14 of the frame 10.

Figure 7:
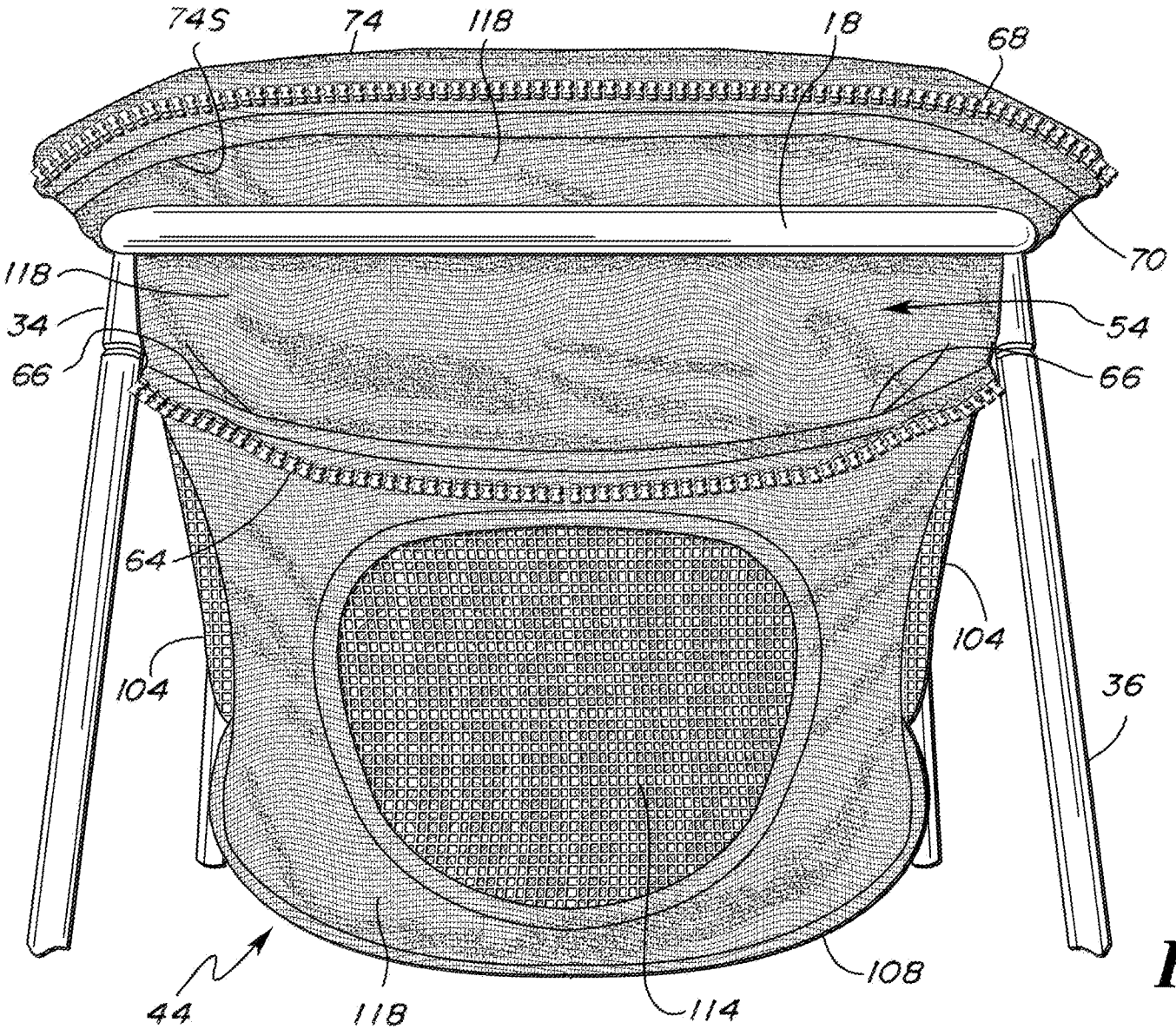
FIG. 7 is a perspective end view of the bassinet of FIG. 2 and shows unzipped receptors for U-shaped portions of the tubular frame.
Figure 8B:
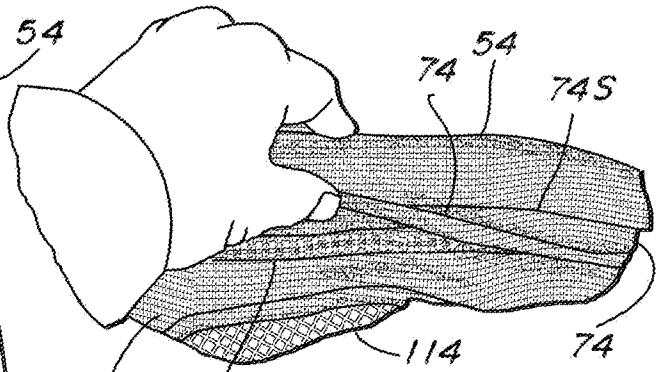
FIG. 8B is a perspective view of a portion of FIG. 8A showing how the flaps for hiding the zippers of the sipped up receptors may be partially turned up to expose the zippers of the zipped up receptors.
Figure 8A:
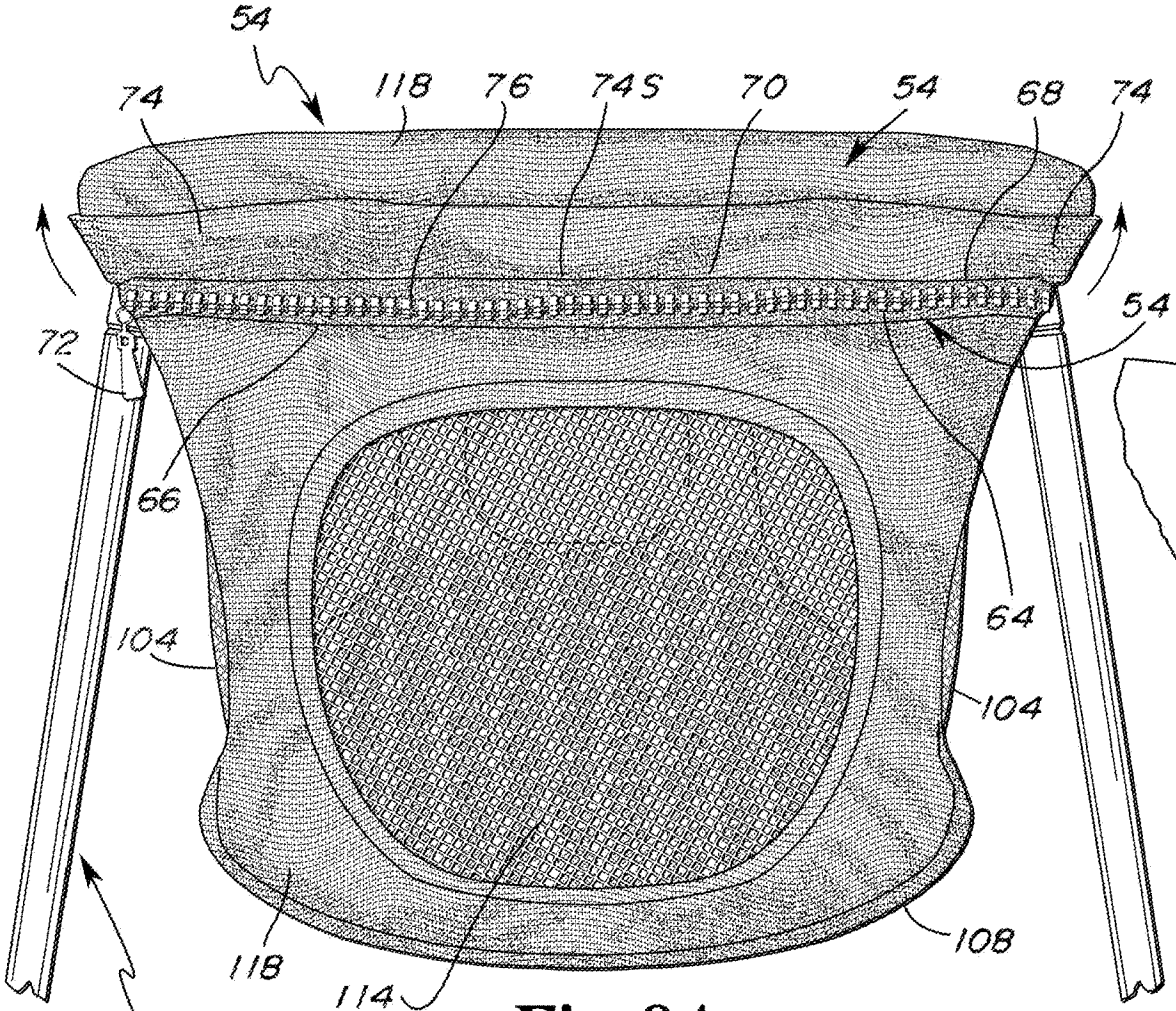

FIG. 7 shows the opened up state of one of the third and fourth sleeves 54. Sleeve 54 includes a curved lower toothed zipper portion 64 on a lower strip 66 of flexible fabric material. Strip 66 and thus zipper portion 64 pivot relative to the sidewall 50 as a whole. FIG. 7 shows the lower zipper portion 64 and lower strip 66 pivoted down. Sleeve 54 includes a curved upper toothed zipper portion 68 on an upper strip 70 of flexible fabric material. FIG. 7 shows the upper zipper portion 68 and upper strip 70 pivoted up. When the zipper portions 64, 68 are engaged, such as shown in FIG. 8A, curved sleeve 54 is closed and provides an oblong base, along with the other curved sleeve 54 and the two straight sleeves 52, from which the receptacle 44 depends. Sleeve 54 is part of the endless sidewall 50. Zipper portions 64, 68 take inside and outside portions of the sidewall 50 to form the curved tubular sleeve 54. The length of the end curved sleeve 54 is about the length of the curved end section 18 of the oblong portion 14 of the frame 10. Zipper portions 64, 68 form an elongate curved connection and is a way that the receptacle end portions can be removed laterally from the curved end sections 18 of the oblong portion 14 of the frame 10.

Zipper portions 64, 68 may be engaged and disengaged at each of the ends of the curved sleeve 54. Each of the ends of one curved sleeve 54 is adjacent to respective open ends of straight sleeves 52. Each of the ends of the other curved sleeve 54 is adjacent to the other respective open ends of straight sleeves 52. In other words: a first end of a first straight sleeve 52 is adjacent to a first end of a first curved sleeve 54; a second end of the first straight sleeve 52 is adjacent to a first end of a second curved sleeve 54; a first end of a second straight sleeve 52 is adjacent to a second end of the first curved sleeve 54; and a second end of a second straight sleeve 52 is adjacent to a second end of the second curved sleeve 54.

Figure 4:
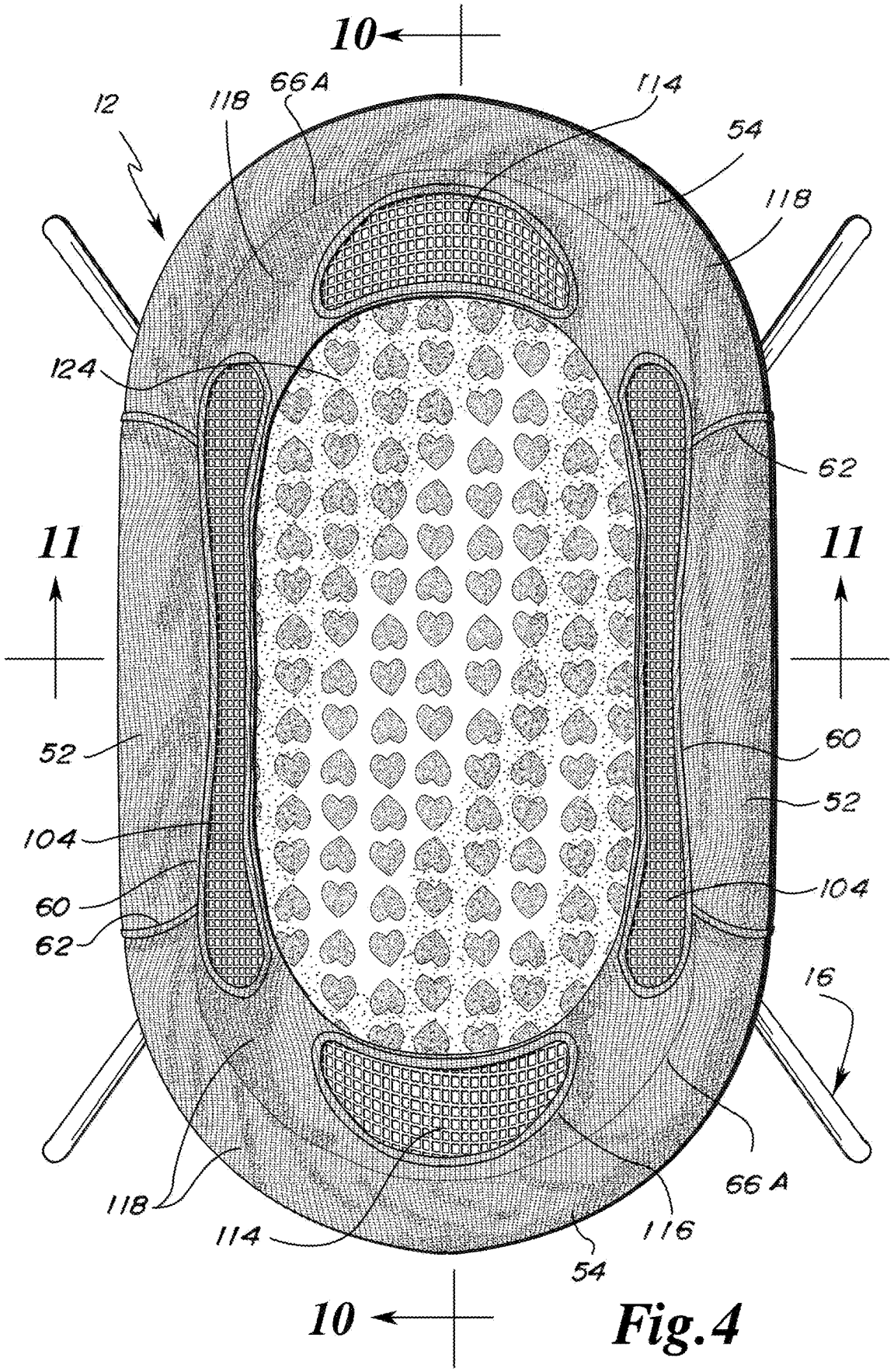
FIG. 4 is a top perspective view of the infant bassinet apparatus of FIG. 2.

Curved end sleeve 54 includes the upper strip 70 and the lower strip 66. Upper strip 70 includes the toothed portion 68. Lower strip 66 includes the toothed portion 64. The lower toothed edge 68 of the upper strip 70 and the upper toothed edge 64 of the lower strip 66 of the sleeve 54 are separated by the zippered connection 76 of the sleeve 54. The upper toothed edge 64 and lower toothed edge 68 of sleeve 54 are spaced apart from each other when the upper strip 70 and lower strip 66 of the sleeve 54 are disengaged from each other by the zippered connection 76. In FIG. 4, the reference number 66A designates the stitching for the lower strip 66.

Figure 3:
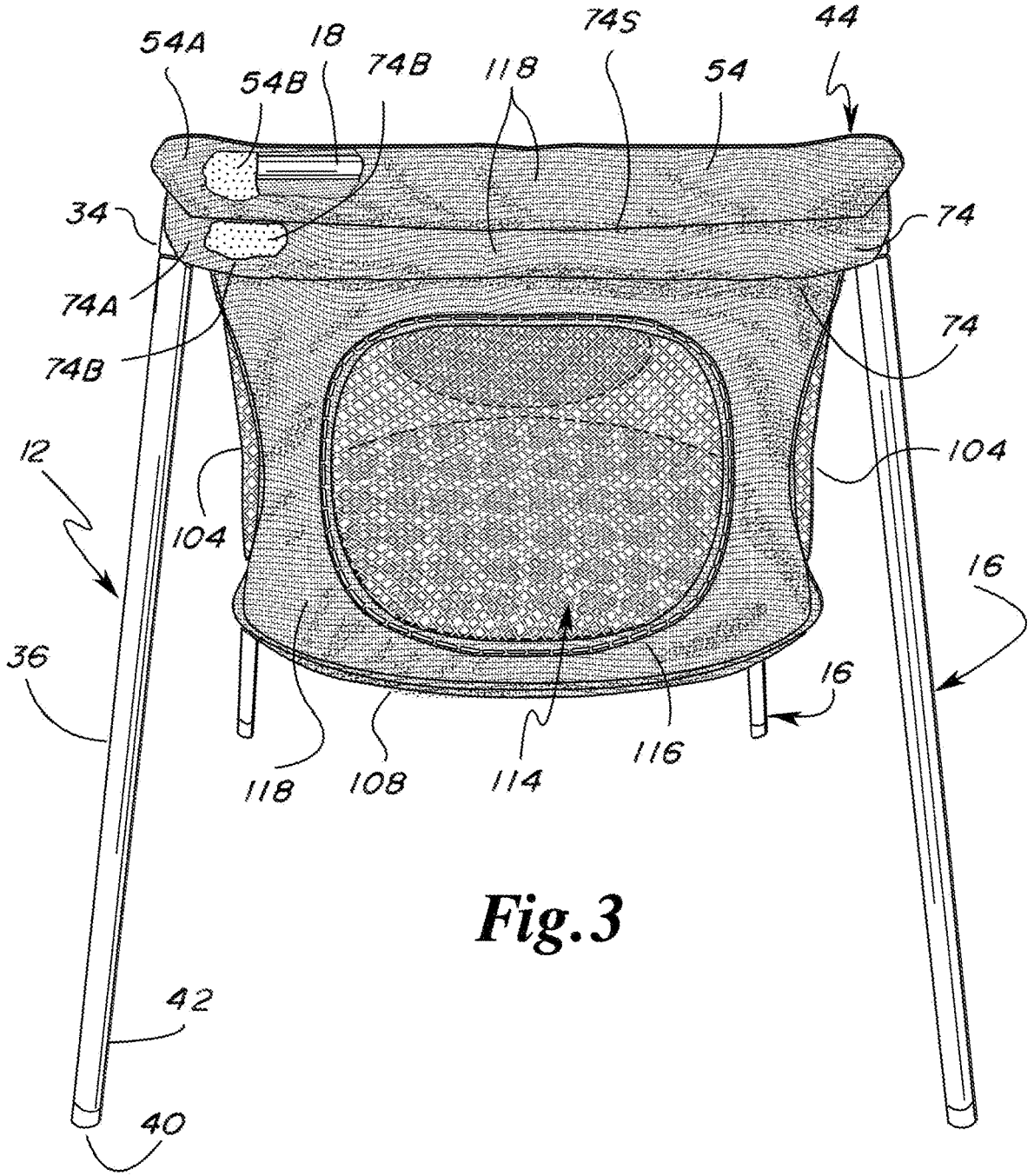
FIG. 3 is an end perspective view of the infant bassinet apparatus of FIG. 2.
Figure 10:
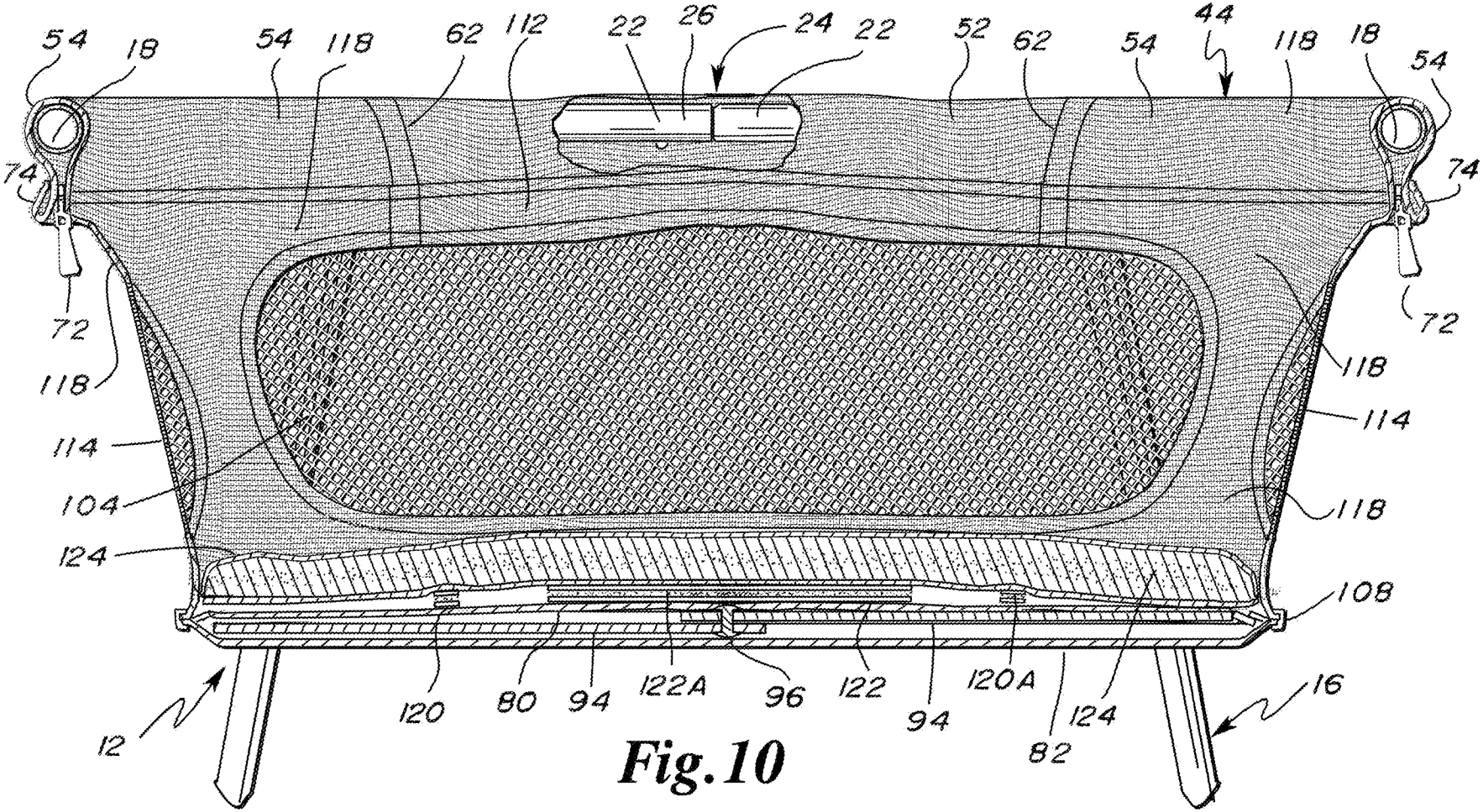
FIG. 10 is a longitudinal diagrammatic view of the bassinet apparatus of FIG. 2 and shows a floor portion in section.

FIG. 8A shows a curved flap 74 that runs the length of curved sleeve 54 and that is turned up in FIG. 8A. Curved flap 74 is normally turned down to cover the engaged zipper portions 64, 68 for aesthetic purposes and also to hide the zipper portions 64, 68 from toddlers or those who seek playtime. Flap 74 also protects the fingers of caretakers who may lift the bassinet apparatus 12 by the curved end sections 18 of the oblong portion 14 of the frame 10. FIG. 8B shows the curved flap 74 having a portion turned up exposing the zipper portions 64, 68 and having another portion turned down hiding and covering the zipper portions 64, 68. Reference number 76 indicates a zipper 76 where zipper 76 is formed by zipper portions 64, 68. There are two flaps 74, one each for each of the zippers 76. One zipper 76 is found on each of the ends of the receptacle 44. As shown in FIG. 10, flap 74 is formed by flexible fabric material doubled back to itself and is tubular from end to end. Flap 74 is a portion of the sidewall 50. Flap 74 is pivotable relative to the sidewall 50 as a whole. Curved flap 74 runs parallel to the curved end sleeve 54 and parallel to the curved end section 18 of the oblong portion 14 of the frame 10. It should be noted that strip 70 is pivotable relative to flap 74, to one-piece portion 118, and to end sleeve 54. Strip 70 is engaged to flap 74 and to one-piece portion 118 with stitching 74S as shown in FIG. 7. Stitching 74S also separates flap 74 from end sleeve 54 as shown in FIG. 3. Teeth 68 are engaged on the elongate edge of strip 70. Stitching 74S does not extend through tubular end sleeve 54.

The closed bottom 48 of the receptacle 44 includes a pocket 78. Pocket 78 is formed by an upper oblong or elongate layer 80 of flexible fabric material and a lowermost oblong or elongate layer 82 of flexible fabric material. The perimeters of the oblong layers 80, 82 are engaged, such as by gluing or stitching. Layer 82 is the lowermost portion of the receptacle 44.

Pocket 78 is openable and closeable by a zipper 84 having a first toothed zipper portion 86 on a curved portion of the perimeter of the upper layer 80 and a second toothed zipper portion 88 extending inwardly from a curved portion of the perimeter of the lowermost layer 82. When opened, zipper 84 defines an opening 90 through which is inserted a relatively rigid oblong floor 92.

Figure 9A:
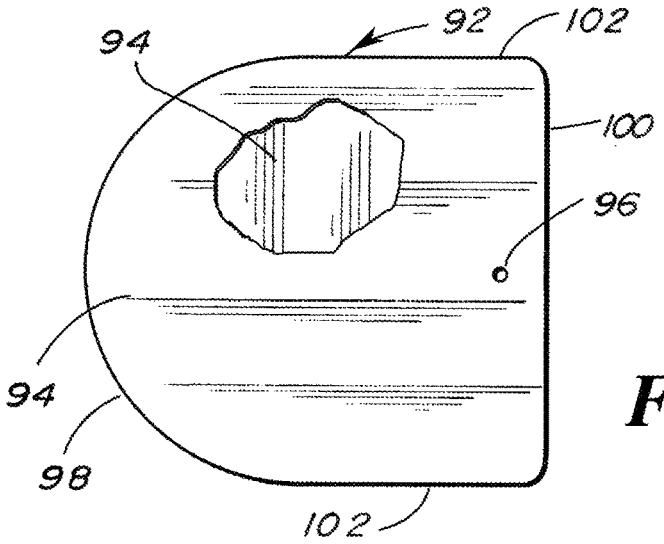
FIG. 9A shows a top view of the floor support apparatus of FIG. 5 where the floor support apparatus is in the compact form or state in which it is shipped and stored.
Figure 9B:
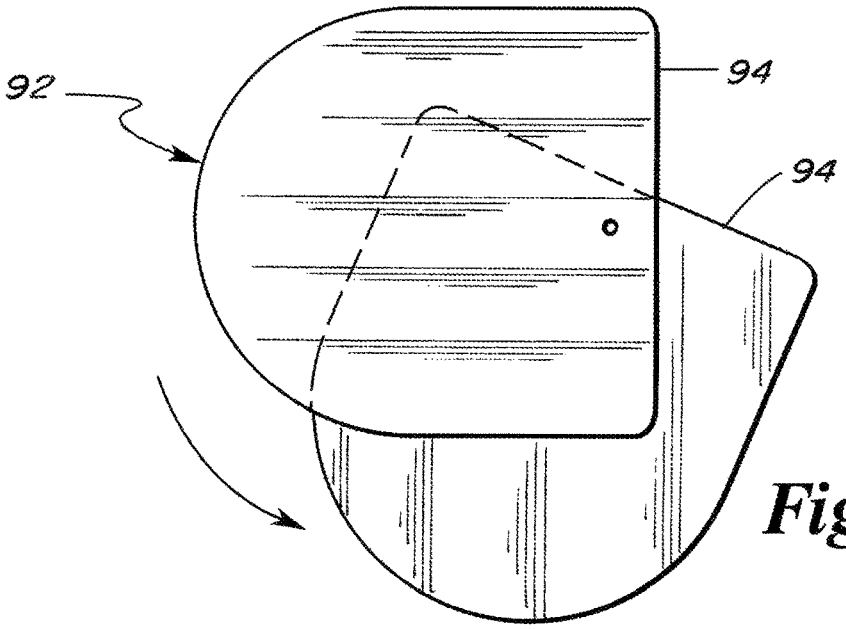
FIG. 9B shows a top view of the floor support apparatus of FIG. 9A in an intermediate or transition state.

Floor 92 is shown in FIG. 9B. Floor 92 includes two identical floor portions 94. Each of the floor portions 94 may be formed of wood, a wood product, a wood composite, an engineered wood, hardboard, or a hard or relatively rigid or relatively semi-rigid plastic or polymer material.

Floor portions 94 are rotatable relative to each other by a pin 96. Floor portions 94 are engaged to each other by the pin 96. Pin 96 may take the form of a rivet.

In FIG. 9A, floor portions 94 are placed back to back to each other. This is the state in which floor 92 is shipped. The shapes of the perimeters of the floor portions 94 are identical. This state is a compact state.

FIG. 9B shows the floor portions 94 rotating relatively away from each other. This state is a transition state or a transitory state.

Figure 9C:
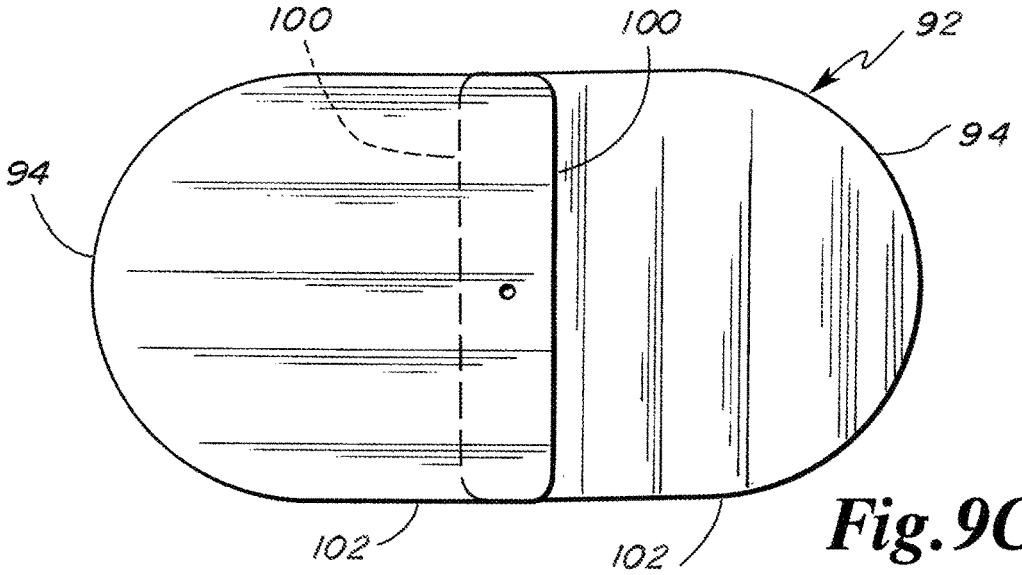
FIG. 9C shows a top view of the floor support apparatus of FIG. 9B in the operating state.

FIG. 9C shows the floor portions 94 forming an oblong or elongate shape. This is the operating state and the operating shape that the floor 92 takes when in the pocket 78. This is shape that the floor 92 takes when being inserted into the pocket 78 through the opening 90. In the oblong shape shown in FIG. 9C, sections of the floor portions 94 overlap each other. This overlapping prevents the closed bottom 48 of the receptacle 44 from forming a V-shape when an infant or toddler is placed into the receptacle 44. This overlapping of relatively rigid portions 94 provides for a relatively flat floor to the receptacle 44 even when the weight of a child or infant bears down on closed bottom 48.

Each of the floor portions 94 includes a curved edge portion 98 that opposes a straight edge portion 100. Each of the floor portions 94 further includes a pair of opposing straight edge portions 102. In the operating state shown in FIG. 9C, straight edge portions 100 run parallel to each other and are offset from each other both in the longitudinal and vertical directions. Pin 96 is spaced from straight edge portion 100 on both of the floor portions 94.

First straight edge portions 102 confront each other in FIG. 9A and second straight edge portions 102 confront each other in FIG. 9A. In FIG. 9C, one first straight edge portion 102 defines a straight line with one second straight edge portion 102 and the other first straight edge portion 102 defines another straight line with the other second straight edge portion 102.

In FIG. 9A, curved edge portion 98 of one floor portion 94 is flush with the curved edge portion 98 of the other floor portion 94. In FIG. 9C, the curved edge portions 98 oppose each other.

When in pocket 78, floor portions 94 are prevented from rotating from the operating position shown in FIG. 9C back to any of the positions shown in FIG. 9B or 9A because the oblong perimeter of the oblong floor 92 in the operating position is about equal to or slightly less than the oblong inner perimeter of the oblong pocket 78.

The joined or connected oblong perimeters of the upper pocket layer 80 and lowermost pocket layer 82 includes a first portion having the zipper 84. The remaining portion of such joined oblong perimeters is a fixed portion, with the integrity of the fixed portion being destroyed if an attempt is made to separate the layers 80, 82 at such fixed portion. This fixed portion may be joined by adhesive or stitching.

Each of first and second curved end sections 18 of the oblong portion 14 of the frame 10 are equidistance from a laterally extending vertical plane, where the laterally extending vertical plane extends through the closed bottom 48 of the receptacle 44. This bottom closed bottom 48 of the receptacle 44 includes the pocket 78, where the pocket 78 includes the lowermost layer 82 and the upper layer 80 and further includes the oblong floor 92 or oblong floor support 94 in the pocket 78 between the lowermost layer 82 and the upper layer 80. The oblong floor support 92 includes first and second portions 94 that overlap each other and are rotatable relative to each other. The laterally extending vertical plane passes through each of the first and second portions 94 of the oblong floor support 92 at the overlapping sections. The oblong floor support 92 has a degree of rigidity greater than the lowermost fabric flexible layer 82 of the pocket 78 and greater than the upper fabric flexible layer 80 of the pocket 78.

Receptacle 44 includes a pair of side mesh portions 104. Side mesh portion 104 is partially bounded by a strip 106 of flexible fabric material that is engaged to non-mesh material of endless sidewall 50. Each of the lower ends of strip 106 is engaged to an oblong strip 108 of flexible fabric material that engages the perimeters of the upper layer 80 and uppermost layer 82 of pocket 78. Between oblong strip 108 and the bottom of side mesh portion 104 is a strip 110 of flexible fabric material. Between the top of side mesh portion 104 and strip 60 is a strip 112 of flexible fabric material. As shown in FIG. 10, ends of strip 112 are engaged, such as by stitching, to one-piece portion 118.

Receptacle 44 includes a pair of end mesh portions 114. End mesh portion 114 is fully bounded by an endless strip 116 of flexible fabric material. Endless strip 116 is adjacent to and spaced from oblong strip 108 that joins the perimeters of lowermost oblong layer 82 and upper oblong layer 80 of pocket 78. Endless strip 116 is spaced from and adjacent to flap 74 and end sleeve zipper 76. Endless strip 116 is spaced from and adjacent to end sections of respective side mesh portions 104.

Each of the side mesh portion 104 and end mesh portion 114 is spaced from and adjacent to strip 108 and thus is adjacent to and spaced from closed bottom 48. Side mesh portion 104 is spaced from and adjacent to intermediate straight sleeve 52. End mesh portion 114 is adjacent to and spaced from curved end sleeve 54.

Side mesh portion 104 and end mesh portion 114 are see through mesh portions.

Receptacle 44 includes a one-piece portion 118 that extends from strip 108, up and about end mesh portion 114, up and around curved end section 18 of the oblong portion 14 of the frame 10, back down on the outer side of end curved sleeve 54, then forms flap 74, and terminates at the upper zipper portion 68. Lower zipper portion 64 is on strip 66 that extends from one-piece portion 118. One-piece portion 118 is engaged, such as by adhesive or stitching, to intermediate straight sleeve 52 by strips 62. Strength to the receptacle 44 is provided by such one-piece portion 118.

Intermediate straight sleeve 52 is one-piece and U-shaped with the bottom ends adhered to each other or stitched to each other by strip 60. The provision of one-piece engaging intermediate straight section 20 of oblong portion 14 of frame 10 provides strength to the receptacle 44.

The upper side of upper layer 80 of pocket 78 includes a pair of laterally extending strips 120 of a hook and loop material such as Velcro®. Strips 120 are on end portions of the upper layer 80, oppose each other, and are parallel to each other. The upper side of upper layer 80 of pocket 78 further includes a pair of laterally extending strips 122. Strips 122 are on side portions of the upper layer 80, oppose each other, and are parallel to each other.

Figure 5:
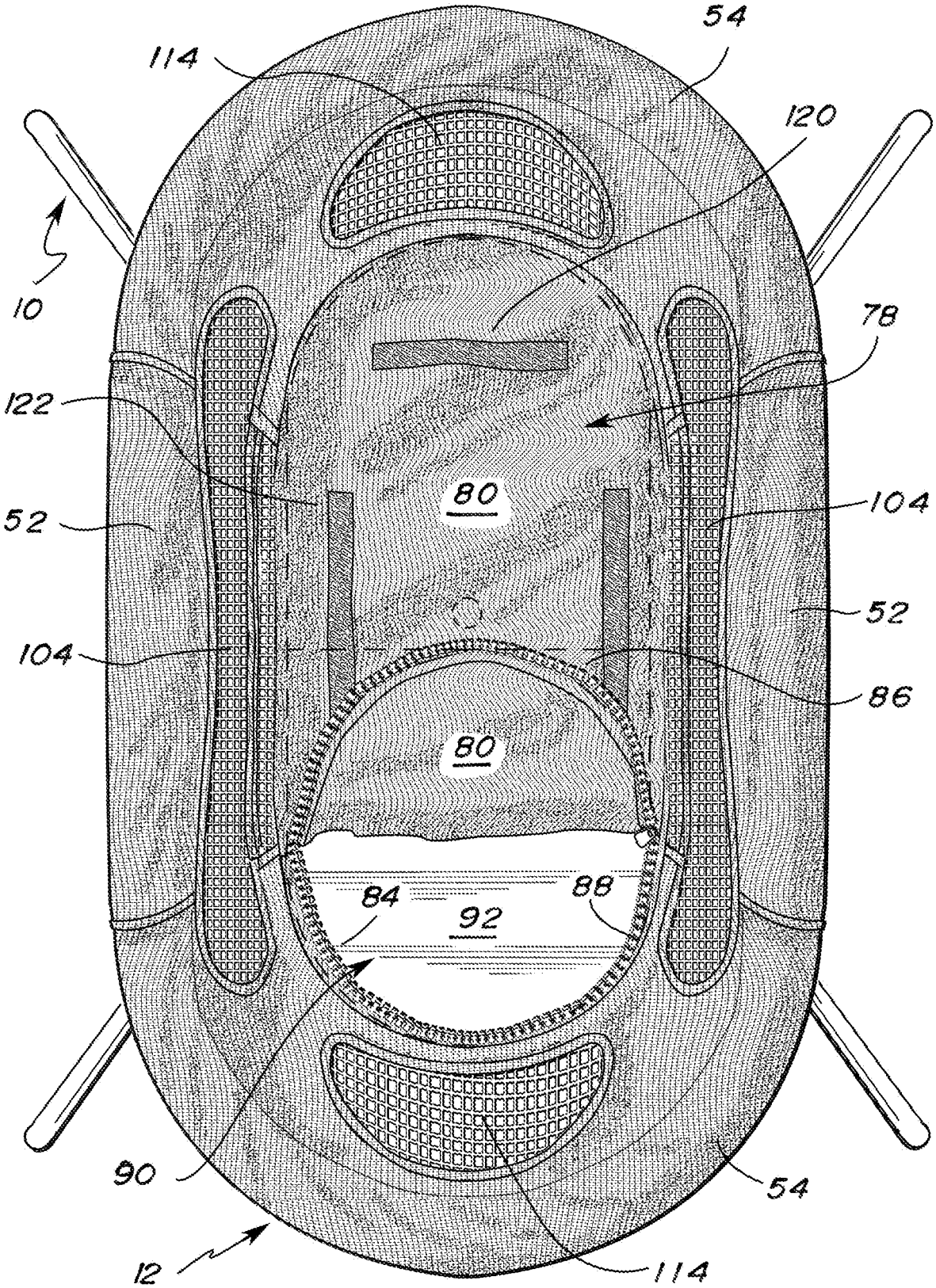
FIG. 5 is a top perspective view of the infant bassinet apparatus of FIG. 4 with the pad removed and with the pocket unzipped so as to show the floor support apparatus.
Figure 6:
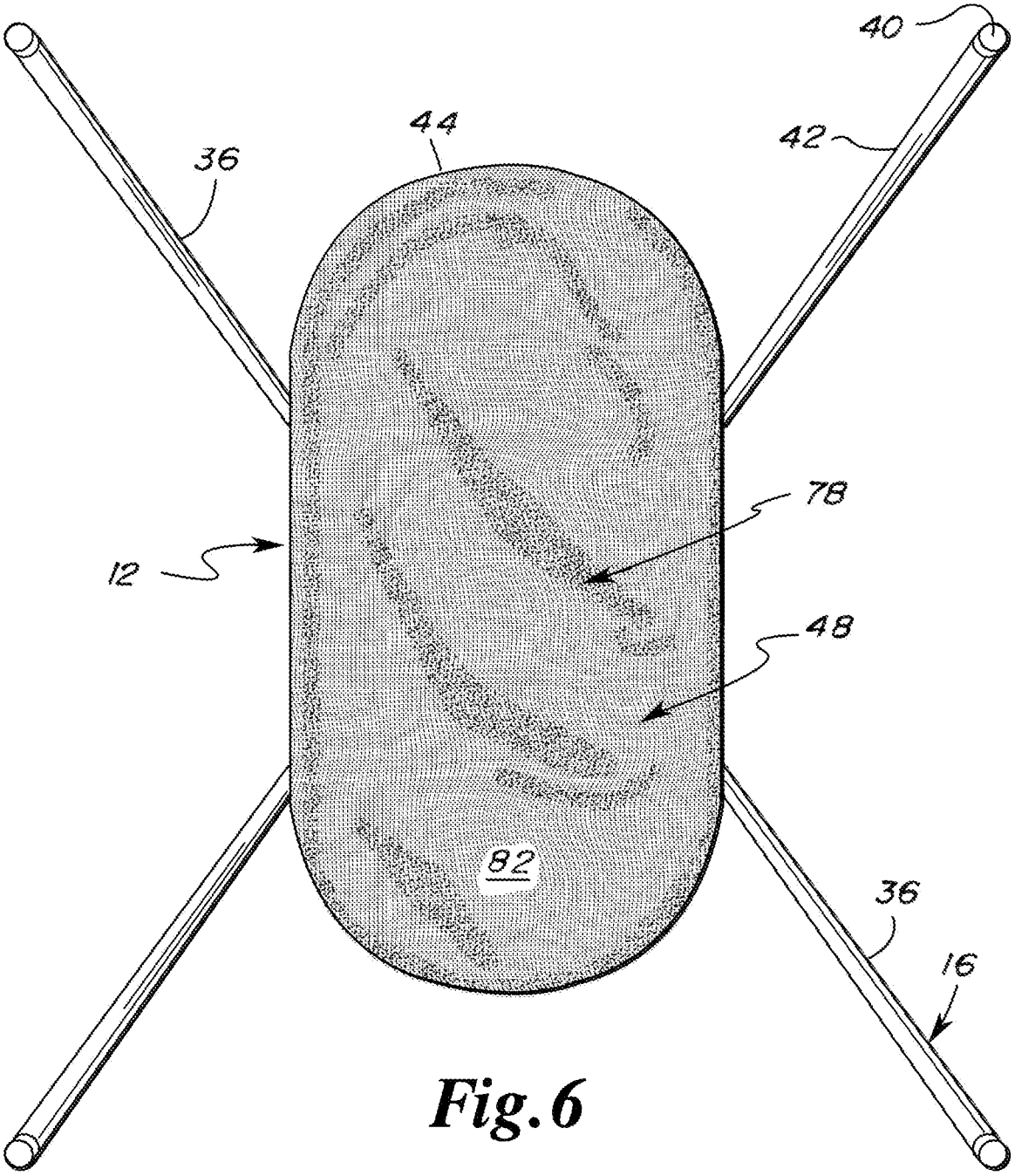
FIG. 6 is a bottom perspective view of the infant bassinet of FIG. 1.

Receptacle 44 further includes an oblong or elongate pad 124 having width (a lateral dimension) and length (a longitudinal dimension) about equal to the lowermost layer 82 and upper layer 80 that form the pocket 78. The underside of oblong pad 124 includes Velcro® strips that perfectly engage Velcro® strips 120, 122 engaged on the upper side of upper layer 80 to engage the pad 124 to the receptacle 44. As shown in FIG. 5, the upper layer 80 of the pocket 78 is spaced from the lower portion of side mesh portion 104. As shown in FIG. 5, the upper layer 80 of the pocket 78 is also spaced from the lower portion of the end mesh portion 114. Then, as shown in FIG. 4, when oblong pad 124 is placed on the upper layer 80 of pocket 78, the upper surface of pad 124 is adjacent to the lower portions of the side mesh portion 104 and end mesh portion 114. With the thickness (or height dimension) of the pad 124, with the bottom portion of end mesh portion 114 being adjacent to the upper surface of oblong pad 124, and with the bottom portion of side mesh portion 104 being adjacent to the upper surface of the oblong pad 124, it is relatively easy for an infant or toddler to see through the mesh portions 104, 114 to establish a connection with his or her surroundings, including members of his or her family.

It should be noted that the closed oblong or elongate bottom 48 includes oblong or elongate pad 124, oblong or elongate floor 94, oblong or elongate pocket 78, the upper oblong or elongate layer 80, and the lower oblong or elongate layer 82. The width and length of closed or elongate oblong bottom 48 is less than the width and length of the oblong or elongate floor portion 14 of frame 10 such that endless sidewall 50 tapers inwardly while the endless sidewall 50 runs downwardly from bottom portions of the straight and end sleeves 52, 54.

FIG. 10 shows a diagrammatic longitudinal section view of the receptacle 44. Working from the bottom of the receptacle 44 to the top of the receptacle 44, one can first identify the lowermost layer 82 of the pocket 78. Then, immediately on top of the lowermost layer 82 is one of the floor portions 94. Then, at a slightly higher altitude, is the other of the floor portions 94. Then, immediately above the floor portions 94 is the upper layer 80 of pocket 78. Then, immediately on the upper layer 80 are the Velcro® strips 120, 122. Then, immediately on the Velcro strips 120, 122 are the associated Velcro® strips 120A, 122A that are engaged to the underside of pad 124. The infant or toddler lies on pad 124.

Figure 11:
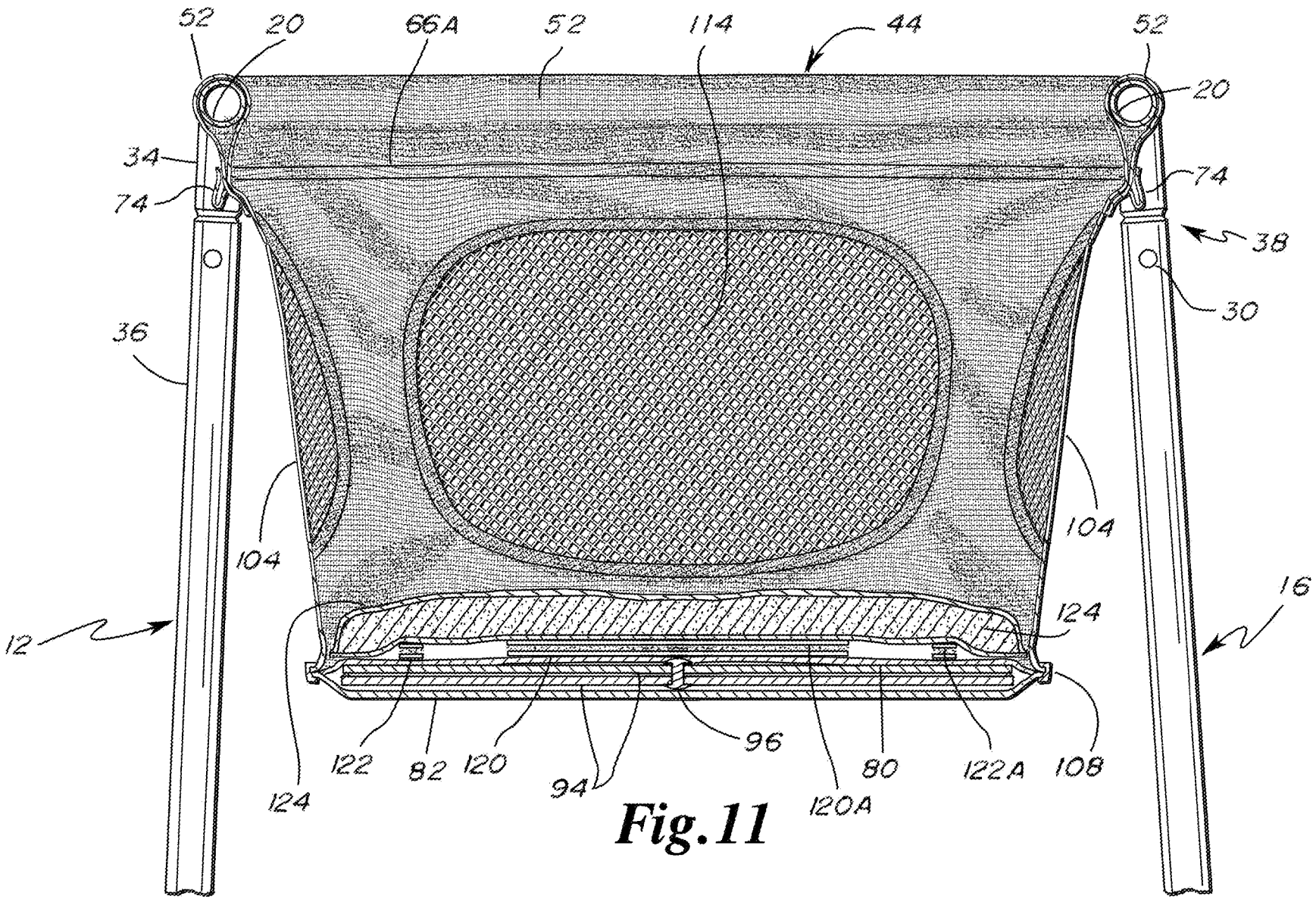
FIG. 11 is a lateral diagrammatic view of the bassinet apparatus of FIG. 2 and shows a floor portion in section.

FIG. 11 shows a diagrammatic lateral section view of the receptacle 44. Working from the bottom of the receptacle 44 to the top of the receptacle 44, one can first identify the lowermost layer 82 of the pocket 78. Then, immediately on top of the lowermost layer 82 is one of the overlapping sections of one of the floor portions 94. Then, immediately on top of the lowermost overlapping section of such floor portion 94, is the overlapping section of the other floor portion 94. Then, immediately above the uppermost overlapping section of the upper floor portion 94 is the upper layer 80 of pocket 78. Then, immediately on the upper layer 80 are the Velcro® strips 120, 122. Then, immediately on the Velcro strips 120, 122 are the associated Velcro® strips 120A, 122A that are engaged to the underside of pad 124. The infant or toddler lies on pad 124.

It should be noted that, for cushioning relative to the oblong portion 14 of the frame 10, each of straight sleeve 52, end sleeve 54, and flap 74 includes an additional interior cushion layer that extends wherever straight sleeve 52 extends, wherever end sleeve 54 extends, and wherever flap 74 extends. For example, FIG. 2 shows in a cut-away an interior resilient cushion layer 52B disposed between an outer layer 52A and straight tube section 20 of oblong frame 14 of frame 10. FIG. 3 shows in a cut-away an interior resilient cushion layer 54B disposed between an outer layer 54A and curved tube section 18 of oblong frame 14 of frame 10. FIG. 3 also shows in a cut-away an interior resilient cushion layer 74B immediately inside of an outer layer 74A.

In operation, in shipment from the factory, the bassinet apparatus 12 is broken down into the following separate parts: 1) the first lower leg portion 36, 2) the second lower leg portion 36, 3) the third lower leg portion 36, 4) the fourth lower leg portion 36, 5) one of the segments 22, with such segment 22 having two integrally connected upper leg portions 34, 6) the other of the segments 22, with such segment 22 having two integrally connected upper leg portions 34, 7) the receptacle 44 without the floor 92, 8) the floor 92 in the compact form shown in FIG. 9A where the two floor portions 94 are rotated to be back to back with each other, and 9) the pad 124. In such an unassembled form, the bassinet apparatus 12 may fit in a relatively small box.

To assemble the bassinet apparatus 12, opposing free ends of the first segment 22 are fed into opposing openings 56 at the open ends of opposing straight intermediate sleeves 52. One free end is male end 28 and the other free end is female end 26. Then the opposing free ends of the second segment 22 are fed into opposing openings 56 at the other open ends of opposing straight intermediate sleeves 52. Again, these free ends are male end 28 and free end 26. Then, in the middle of each of the straight intermediate sleeves 52, the connections 24 are made, where the male end 28 of the first segment 22 engages the female end of the second segment 22 and where the male end 28 of the second segment 22 engages the female end of the first segment 22. Then one of the end sleeve zippers 76 is opened to space its zipper portions 64, 68 apart from each other, whereupon sections of the one-piece portion 118 and zipper portions 64, 68 are manipulated to capture the curved end section 18 between the zipper portions 64, 68 as shown in FIG. 7, whereupon the end sleeve zipper 76 is engaged to associated ends of zipper portions 64, 68, whereupon end sleeve zipper 76 is pulled to bring zipper portions 64, 68 together and form the tubular curved end sleeve 54. Then flap 74 may be pivoted down to cover the zipper 76. Then the other end sleeve zipper 76 is opened and such steps repeated with the other curved end sleeve 54 so as to engage the other curved end section 18. Then the pocket zipper 84 is opened and floor portions 94 are rotated to the oblong form shown in FIG. 9C. Then, in such oblong state, the floor 92 is inserted into pocket 78 through opening 90. Then pocket zipper 84 is closed. Then the lower leg portions 36 may be engaged to the upper leg portions 34. Then pad 124 may be placed onto the upper layer 80 of the pocket 78 and engaged thereto with the Velcro® strips 120, 120A, 122, and 122A. Then an infant, baby, or toddler may be placed on the pad 124.

While the child is sleeping, the oblique legs 16 provide a wide foot plant. The two one-piece portions 118 and one piece sleeves 52 provide strength from the oblong portion 14 of the frame 10 to the closed bottom 48. The curved end sleeves 54 provide a fabric lock to an attempted longitudinal separation of the oblong portion 14 of the frame 10. The connections 24 provide a mechanical lock against an attempted longitudinal separation of the oblong portion 14 of the frame 10. The connections 24 are hidden in the straight intermediate sleeves 52 to minimize the chances that those not in the know, such as children, may fiddle with and longitudinally separate the segments 22 and thus longitudinally separate the oblong portion 14 of the frame 10 into two parts if the children already have the curved end sleeves 54 zipped open. Upon awakening, the child can immediately and readily see out of the receptacle 44 since there are two end mesh portions 114 and two side mesh portions 104 and since the pad 124 is positioned at a height adjacent to the mesh portions 104, 114. The open top 46 provides ready access for a caretaker to reach in and lift the child out of the receptacle 44.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bassinet apparatus comprising:

a) a frame that comprises:

i) an oblong portion that defines a plane, the oblong portion having a first curved end section and a second curved end section, the first and second curved end sections opposing each other, the oblong portion further having first and second intermediate straight sections, the first intermediate straight section being between the first and second curved end sections, the second intermediate straight section being between the first and second curved end sections, the first and second intermediate straight sections opposing each other; and ii) first, second, third, and fourth oblique legs engaged to the oblong portion for supporting the bassinet apparatus relative to a surface, the first, second, third, and fourth oblique legs being oblique relative to the plane that the oblong portion defines;

b) a receptacle engaged to and depending from the oblong portion, the receptacle comprising an open top, a closed bottom, and an endless sidewall between the open top and closed bottom, the receptacle further comprising:

i) a first sleeve for receiving the first intermediate straight section of the oblong portion of the frame, the first sleeve having first and second opposing open ends, the first sleeve defining a first closed tube between the first and second opposing open ends of the first sleeve, the first closed tube being openable between the first and second open ends of the first sleeve only by destroying an integrity of the first sleeve, the frame being engaged and disengaged to the first sleeve through the first and second open ends of the first sleeve;

ii) a second sleeve for receiving the second intermediate straight section of the oblong portion of the frame, the second sleeve having first and second opposing open ends, the second sleeve defining a second closed tube between the first and second opposing ends of the second sleeve, the second closed tube being openable between the first and second open ends of the second sleeve only by destroying an integrity of the second sleeve, the frame being engaged and disengaged to the second sleeve through the first and second open ends of the second sleeve;

iii) a third sleeve for receiving the first curved end section of the oblong portion of the frame, the third sleeve having first and second ends and a connection between the first and second ends of the third sleeve, the third sleeve being openable along the connection of the third sleeve such that the third sleeve may be engaged and disengaged laterally from the first curved end section of the oblong portion of the frame;

iv) a fourth sleeve for receiving the second curved end section of the oblong portion of the frame, the fourth sleeve having first and second ends and a connection between the first and second ends of the fourth sleeve, the fourth sleeve being openable along the connection of the fourth sleeve such that the fourth sleeve may be engaged and disengaged laterally from the second curved end section of the oblong portion of the frame; and v) wherein each of the third and fourth sleeves includes an upper portion and a lower portion, a lower edge of the upper portion and an upper edge of the lower portion of the third sleeve separated by the connection of the third sleeve, a lower edge of the upper portion and an upper edge of the lower portion of the fourth sleeve separated by the connection of the fourth sleeve, the upper and lower edges of the third sleeve being spaced apart from each other when the upper and lower portions of the third sleeve are disengaged from each other by said connection, the upper and lower edges of the fourth sleeve being spaced apart from each other when the upper and lower portions of the fourth sleeve are disengaged from each other by said connection.

2. The bassinet apparatus of claim 1, wherein:

a) the first open end of the first sleeve is adjacent to the first end of the third sleeve;

b) the second open end of the first sleeve is adjacent to the first end of the fourth sleeve;

c) the first open end of the second sleeve is adjacent to the second end of the third sleeve; and d) the second open end of the second sleeve is adjacent to the second end of the fourth sleeve.

3. The bassinet apparatus of claim 1, wherein the oblong portion of the frame includes first and second segments, the first segment having an entirety of the first curved end section, part of the first intermediate straight section, and part of the second intermediate straight section, the second segment having an entirety of the second curved end section, part of the first intermediate straight section, and part of the second intermediate straight section, the first and second segments being engagable to and disengagable from each other.

4. The bassinet apparatus of claim 1, wherein the first intermediate straight section of the oblong portion of the frame leads into the first curved end section of the oblong portion of the frame at a first location, wherein the first intermediate straight section of the oblong portion of the frame leads into the second curved end section of the oblong portion of the frame at a second location, wherein the second intermediate straight section of the oblong portion of the frame leads into the first curved end section of the oblong portion of the frame at a third location, and wherein the second intermediate straight section of the oblong portion of the frame leads into the second curved end section of the oblong portion of the frame at a fourth location, the first, second, third, and fourth legs depending from the first, second, third, and fourth locations, respectively.

5. The bassinet apparatus of claim 1, wherein each of the first, second, third, and fourth legs includes upper and lower leg portions, the upper leg portion having an integral connection with the oblong portion of the frame such that removing the upper leg portion from the oblong portion of the frame at the integral connection destroys an integrity of said integral connection.

6. The bassinet apparatus of claim 1, wherein each of the first, second, third, and fourth legs includes upper and lower leg portions, the lower leg portion of each of the first, second, third, and fourth legs being engagable and disengagable from the upper leg portion of each of the first, second, third, and fourth legs, respectively.

7. The bassinet apparatus of claim 1, wherein each of the first, second, third, and fourth legs includes upper and lower leg portions, the upper leg portion having an integral connection with the oblong portion of the frame such that removing the upper leg portion from the oblong portion of the frame at the integral connection destroys an integrity of said integral connection, and the lower leg portion of each of the first, second, third, and fourth legs being engagable and disengagable from the upper leg portion of each of the first, second, third, and fourth legs.

8. The bassinet apparatus of claim 1, wherein the closed bottom includes a pocket, the pocket including an upper oblong layer and a lower oblong layer, the upper and lower oblong layers having an oblong connection therebetween, a first portion of the oblong connection being openable and closeable, a second portion of the oblong connection being fixed such that opening the second portion of the oblong connection destroys an integrity of the second portion of the oblong connection, and further comprising an oblong floor support in the pocket between the upper and lower oblong layers.

9. The bassinet apparatus of claim 8, wherein the oblong floor support includes first and second portions, the first and second portions having an identical shape, the first and second portions pivotally engaged to each other, the first and second portions having a compact shape where peripheries of the first and second portions are aligned with each other, the first and second portions having an operating oblong shape, the first and second portions being pivotable from the compact shape to the operating oblong shape.

10. The bassinet apparatus of claim 1, and further comprising first and second flexible flaps, the first flap covering the connection of the third sleeve, the first flap extending parallel to the first curved end section of the oblong portion of the frame, the second flap covering the connection of the fourth sleeve, the second flap extending parallel to the second curved end section of the oblong portion of the frame.

11. The bassinet apparatus of claim 1, wherein the first and second curved end sections are equidistance from a laterally extending vertical plane, the laterally extending vertical plane extending through the closed bottom of the receptacle, the closed bottom of the receptacle including a pocket, the pocket including a lowermost layer and an upper layer and further including an oblong floor support in the pocket between the lowermost layer and upper layer, the oblong floor support having first and second portions that overlap each other and are rotatable relative to each other, the laterally extending vertical plane passing through each of the first and second portions of the oblong floor support, the oblong floor support having a degree of rigidity greater than the lowermost layer of the pocket and greater than the upper layer of the pocket.

* * * * *